United States Patent [19]

Varley

[11] Patent Number: 4,565,326

[45] Date of Patent: Jan. 21, 1986

[54] METHOD AND APPARATUS FOR REMOVING VENEER FROM REWORKED MEDICINE TABLETS

[75] Inventor: Willard D. Varley, Wilson, N.C.

[73] Assignee: E. R. Squibb & Sons, Inc., Princeton, N.J.

[21] Appl. No.: 681,528

[22] Filed: Dec. 14, 1984

[51] Int. Cl.[4] ..... B02C 23/08; B07B 4/08

[52] U.S. Cl. ..... 241/24; 209/139 R; 209/3; 209/37; 209/474; 209/494; 241/79.1

[58] Field of Search ..... 209/474, 475, 476, 477, 209/466, 468, 471, 490, 494, 138, 139 R, 2, 150, 140, 141, 36, 37, 3, 1; 241/DIG. 27, 79.1, 24

[56] References Cited

U.S. PATENT DOCUMENTS

| | | | |
|---|---|---|---|
| 1,649,781 | 11/1927 | Kopf | 209/37 X |
| 2,638,219 | 5/1953 | Gordon et al. | 209/139.1 X |
| 2,808,929 | 9/1957 | Fisher | 209/36 |

FOREIGN PATENT DOCUMENTS

| | | | |
|---|---|---|---|
| 213076 | 6/1956 | Australia | 209/466 |
| 424310 | 1/1926 | Fed. Rep. of Germany | 209/36 |

*Primary Examiner*—Frank W. Lutter
*Assistant Examiner*—Thomas M. Lithgow
*Attorney, Agent, or Firm*—Lawrence S. Levinson; Sanford J. Asman

[57] ABSTRACT

The invention is a method and apparatus for removing veneer coating shards from granular, medicinal formulations which are being reworked. The formulation is ground up, sifted to remove the smaller pieces which do not contain veneer shards, and then placed into an air suspension under an inverted funnel-like separator cone. The separator cone has air outlets for the air suspension apparatus, as well as a vacuum inlet, adjacent its upper end. The light veneer shards ride up the sloped walls of the separator cone, and they are sucked into the vacuum inlet, thereby removing them from the granulation.

6 Claims, 2 Drawing Figures

METHOD AND APPARATUS FOR REMOVING VENEER FROM REWORKED MEDICINE TABLETS

BACKGROUND OF THE INVENTION

The present invention relates to a device used in the manufacture of medicine tablets. In particular, it relates to an apparatus and method for removing veneer shards from granulations.

In the manufacture of some medicine tablets, a veneer coating film is used. When such tablets must be reworked, it is important to remove the shards of veneer coating film which remain in the granulated material, because the shards remaining in the granulation have a tendency to cause newly made tablets to be soft, due to the elasticity of the veneer coating film. In addition, the presence of the veneer coating film in the granulation can cause the internal structure of newly made tablets to be weak, as a result of moisture introduced through a "wicking" effect.

SUMMARY OF THE INVENTION

The present invention is a device and method used for removing a veneer coating film from veneer coated tablets which are ground for retwork. In accordance with the method, tablets to be reworked are milled, and the resulting granulation is sifted through a screen using a vibratory screener. The larger material, containing the veneer coating film, is placed in a fluid bed dryer dolly for separation. The dryer dolly is placed into the present system and a fan is turned on to suspend the granulation. The damper is slowly opened, thereby lifting the granulation using the airflow. The much lighter veneer coating is lifted up along the walls of a separator cone, and goes out a vacuum outlet hose at the top of the cone. A hole around the vacuum outlet hose allows air to flow through the cone and through filter bags surrounding the cone. The cone walls localize the lighter veneer coating shards for removal with vacuum.

DETAILED DESCRIPTION OF THE PREFERRED EMBODIMENT

Figure 1:
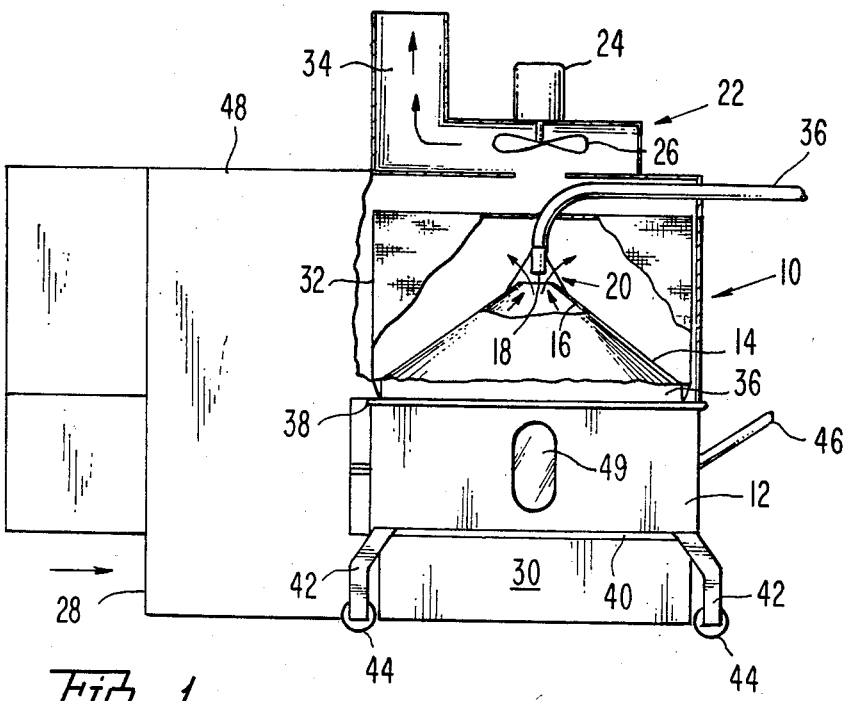
FIG. 1 is a partial cross-sectional view of the present invention.
Figure 2:
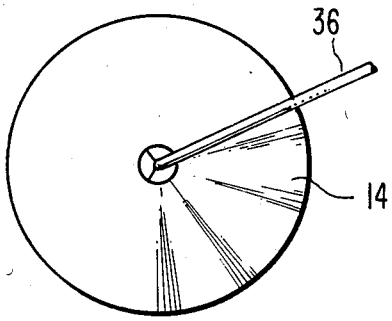
FIG. 2 is a top view of the separator cone which makes up an essential part of the present invention.

Referring to FIG. 1, a cross-section of the veneer removing apparatus 10 of the present invention is shown. In accordance with the invention, medicine tables which require rework are ground up. The ground up material includes shards of veneer coating as well as the medicinal granulation. The grinding is typically accomplished by milling at slow speed. For example, in a typical grinding operation which typically takes place in a Fitzpatrick Mill, a 0.093 screen is used with knives forward at slow speed in a manner well known in the art.

The resulting granulation is sifted through a 20 mesh screen using a vibratory screen. The material which passes through the 20 mesh screen contains very little veneer coating and does not require any further separation. The larger material, i.e., the material which does not pass through the 20 mesh screen, is placed in a fluid bed dryer dolly 12 for separation. The dryer dolly 12 is rolled into place under a separator cone 14. The separator cone 14 has sloped walls 16 which lead upward to a vacuum inlet 18 which is surrounded by an airflow opening 20. In use, the separator cone 14 is part of an exhaust apparatus 22 in which an exhaust fan 24 drives fan blades 26 to move air upward from an input port 28 through a plenum 30, then through the dryer dolly 12. The air flow lifts the granulation in the dryer dolly 12 upward into the separator cone 14, with airflow continuing out through the air hole 20, then through a filter bag 32 which surrounds the separator cone 14. Air continues upward, being pulled by the fan 26 out through an exhaust opening 34.

While the granulation is held in the air suspension, a vacuum is placed on a vacuum line 36. The air flow serves to cause the lighter veneer coating shards to be lifted up along the separator cone walls 16 and toward the vacuum inlet port 18. In practice, it has been found that the cone walls 16 effectively localize the lighter veneer coating shards for removal with vacuum.

As will be obvious, the specific details of the present invention may be modified for particular applications. However, in the preferred embodiment 10, the separator cone 14 has a circular, inverted funnel appearance when viewed from the top. Other shapes may also be used without departing from the present invention, so long as there is an inverted upward slope on the walls 16 of the separator cone 14. Thus, rectangular sidewalls can be used. The shape of the dryer dolly 12 should preferably conform to the shape of the separator cone 14. Accordingly, the present invention uses a round dryer dolly 12. In addition, a standard gasket 36 and a pair of standard air seals 38, 40 are used in the present invention in which the dryer dolly 12 is mounted on legs 42 which each have wheels 44 to facilitate the movement of the dryer dolly into an explosion proof apparatus 48. The dryer dolly also includes a handle 46 and a viewing window 49.

I claim:

1. An apparatus for removing veneer shards from reworked medicine tablets comprising:

(a) means for holding granulated material comprised of milled medicine tablets, some of said granulated material being comprised of medicinal granulation and some of said granulated material being comprised of lighter veneer shards;

(b) a separator cone having one or more walls which slope upward and inward defining an air flow outlet at the top of said separator cone, said separator cone being above said means for holding said granulated material, said means for holding granulated material being comprised of a fluid bed dryer dolly which is adapted to be placed into an upward flow of air beneath said separator cone;

(c) means for suspending said granulated material in an air suspension beneath said separator cone to cause said vaneer coating shards to rise up said one or more walls;

(d) a vacuum inlet above, adjacent to and spaced from said air flow outlet, said vacuum inlet being connected to a vacuum and serving to ingest material which is lighter than said granulated medicinal granulation which is to be retained in the air suspension, whereby said veneer shards in said granulated material will be extracted from the remaining medicinal granulation in the air suspension.

2. The apparatus of claim 1 wherein said means for suspending said granulated material in said air suspension comprises an exhaust fan above said separator cone and said dryer dolly.

3. The apparatus of claim 2 wherein said separator cone has a circular invented funnel appearance when viewed from the top.

4. The method of extracting veneer from medicinal formulations which have been formed into tablets comprising the steps of:

(a) grinding the tablets which are to be reworked;

(b) sifting the ground formulation to separate an oversize portion which contains veneer coating shards and granulation from an undersize portion which is substantially free of such veneer coating shards;

(c) placing said oversize portion into a fluid bed dryer dolly which is placed beneath a separator cone device having one or more walls which slope upward and inward to define an airflow outlet at the top of said separator cone device;

(d) creating an airflow suspending the oversize portion of the ground formulation which contains said veneer coating shards in said air flow thereby creating an air suspension beneath said separator cone device, whereby said veneer coating shards will have a tendency to ride up said one or more walls in the air flow which provides said air suspension; and (e) removing said veneer coating shards from said air suspension by providing a vacuum inlet above, adjacent to, and spaced from the airflow outlet whereby the vaneer coating shards are ingested by said vacuum inlet.

5. The method of claim 4 wherein said grinding step is accomplished in a pharmaceutical hammer mill.

6. The method of claim 5 wherein said step of sifting is comprised of using a vibratory screener.

* * * * *